US010188893B2

(12) United States Patent
Johnson et al.

(10) Patent No.: US 10,188,893 B2
(45) Date of Patent: Jan. 29, 2019

(54) HANDHELD WEIGHTED EXERCISING APPARATUS

(71) Applicant: Mitz Fitness Limited, Cheshire (GB)

(72) Inventors: Greg Kenneth Johnson, Cheshire (GB); Matthew George Kelvie, Kent (GB)

(73) Assignees: Mitz Fitness Limited, Cheshire (GB); Greg Kenneth Johnson, Cheshire (GB)

( * ) Notice: Subject to any disclaimer, the term of this patent is extended or adjusted under 35 U.S.C. 154(b) by 0 days.

(21) Appl. No.: 15/092,361

(22) Filed: Apr. 6, 2016

(65) Prior Publication Data

US 2017/0001058 A1 Jan. 5, 2017

Related U.S. Application Data

(63) Continuation of application No. 14/514,283, filed on Oct. 14, 2014, now abandoned, which is a (Continued)

(30) Foreign Application Priority Data

Apr. 13, 2012 (GB) ..... 1206508

(51) Int. Cl.

| | |
|---|---|
| ***A63B 21/072*** | (2006.01) |
| ***A63B 21/065*** | (2006.01) |
| ***A63B 21/00*** | (2006.01) |
| ***A63B 23/12*** | (2006.01) |
| *A63B 71/14* | (2006.01) |

(52) U.S. Cl.

CPC ..... *A63B 21/065* (2013.01); *A63B 21/072* (2013.01); *A63B 21/0726* (2013.01); *A63B 21/40* (2015.10); *A63B 21/4019* (2015.10); *A63B 21/4021* (2015.10); *A63B 21/4035* (2015.10); *A63B 23/12* (2013.01); *A63B 71/141* (2013.01)

(58) Field of Classification Search

CPC . A63B 21/065; A63B 21/072; A63B 21/0726; A63B 21/075; A63B 21/1438; A63B 21/1442; A63B 21/1469; A63B 21/4019; A63B 21/4021; A63B 21/4025; A63B 21/4035; A63B 23/16; A63B 31/00; A63B 31/10; A63B 31/12; A63B 31/14

USPC ..... 482/44–50, 106–109

See application file for complete search history.

(56) References Cited

U.S. PATENT DOCUMENTS

| | | | | |
|---|---|---|---|---|
| 113,966 A | | 4/1871 | Ballou | |
| 3,855,633 A | * | 12/1974 | Rhee | A63B 71/14 2/161.1 |

(Continued)

FOREIGN PATENT DOCUMENTS

WO 01/85263 A1 11/2011

OTHER PUBLICATIONS

PCT Search Report/Written Opinion in parent application PCT/GB2013/000165.

*Primary Examiner* — Gregory Winter
(74) *Attorney, Agent, or Firm* — Brooks Kushman P.C.

(57) ABSTRACT

An exercise apparatus has a housing for substantially enclosing a hand of a user, an opening within the housing for receiving a hand of the user, a handle within the housing, and vents in the housing, which is weighted and balanced whereby in use the user grips the handle to perform resistance and aerobic exercises using the exercise apparatus.

10 Claims, 7 Drawing Sheets

Related U.S. Application Data continuation-in-part of application No. PCT/GB2013/000165, filed on Apr. 12, 2013.

(56) References Cited

U.S. PATENT DOCUMENTS

| | | | | | |
|---|---|---|---|---|---|
| 4,585,228 | A * | 4/1986 | Olson | A63B 21/065 | 482/105 |
| 4,632,387 | A * | 12/1986 | Guzman | A63B 21/0084 | 441/58 |
| 5,302,165 | A * | 4/1994 | Caruthers | A63B 21/0605 | 482/108 |
| 5,964,683 | A * | 10/1999 | Norblom | A63B 69/26 | 2/16 |
| 6,001,049 | A * | 12/1999 | Frey | A63B 21/0603 | 482/105 |
| 6,569,066 | B1 * | 5/2003 | Patterson | A63B 21/0552 | 482/106 |
| 8,262,546 | B1 * | 9/2012 | Lashinske | A63B 21/0602 | 482/109 |
| 8,382,647 | B1 * | 2/2013 | Hodes | A63B 21/072 | 482/108 |
| 2003/0134727 | A1 * | 7/2003 | Yu | A63B 21/0004 | 482/110 |
| 2005/0227829 | A1 | 10/2005 | Smith | | |
| 2008/0051272 | A1 * | 2/2008 | Lazar | A63B 21/06 | 482/139 |

* cited by examiner

HANDHELD WEIGHTED EXERCISING APPARATUS

The present invention relates to exercise devices, and more particularly to exercise devices for use during resistance training.

Many people engage in resistance training using weights, to build strength and increase overall fitness. Weight training is a common type of strength training for developing the strength and size of a person's muscles. It typically uses the force of gravity to oppose the force generated by the muscles. Weighted barbells, dumbbells or kettlebells are lifted and moved by the user in different ways to achieve different effects on a range of muscle groups.

Weighted hand and wrist devices are commonly used for strengthening upper extremity muscles, both for rehabilitation as well as recreational exercises. Typically hand and wrist exercise devices comprise one or more weight integrated elements affixed to glove-like bodies or weighted devices which can be lifted, such as kettlebells or dumbbells.

The prior art shows a number of devices which are attached to the hands and/or wrists or gripped by a handle to perform upper extremity exercises.

U.S. Pat. No. 4,247,097 (Schwartz) discloses an invention which comprises a weighted glove, secured to the user's wrist by wrist straps. Weights are incorporated into the wrist portion of the glove, as well as into the palm and body regions of the glove. Such a configuration limits the mobility of the hand and wrist and hence limits the types of exercises which may be performed when wearing the glove. The weight is also permanently attached to the hand, which can cause injury should the user come into difficulties and need to release the weight immediately.

US2002128120 (Cook) comprises a weighted boxing glove which incorporates weight elements throughout the glove such that the weight is evenly distributed and the hands and forearms of the user experience the distribution. The glove is secured at the wrist and consists of two compartments—one for the thumb and the other for the rest of the users' hand. This configuration, in conjunction with the bulky design, limits exercises when wearing the glove. It is also permanently attached to the hand, which can cause injury if the user should need to release the gloves immediately.

U.S. Pat. No. 4,377,282 (Hayes) proposes a wrist exercising device which comprises an elongated frame within an enclosed body in which the user places his/her hand. The frame comprises a grip member on the proximal end and a weighted member at the distal end. The grip member may be adjusted longitudinally. The device is aimed at simulating a pitching motion and thus includes an additional wrist guard. This prevents full straightening of the wrist and thus inhibits certain hand and wrist motions and exercises.

Relevant prior art also includes kettlebells—as described in US2004005970 (Anderson). Kettlebells comprise a handle and a weight positioned distal to the handle.

Devices such as those described in the prior art either exercise specific targeted muscle groups dependent on where the weights are placed or are designed such that they limit exercises by restricting the users' movement.

In accordance with the invention, there is provide an exercise apparatus comprising:

a housing for substantially enclosing a hand of a user wherein the housing incorporates a plurality of vents;

an opening within the housing for receiving the hand of the user;

a handle inside the housing; and at least one weight provided by, configured within or disposed in relation to the housing, whereby in use, the user grips the handle with their hand inside the housing, to lift the at least one weight to perform exercises with the exercise apparatus.

The housing may typically comprise an upper surface, a lower surface and sides between the upper and lower surface to form a complete housing. A closed end portion and an opening in the opposing end for receiving the end of the housing are provided. The apparatus is typically configured to receive the hand and extend, in use, up to the wrist area of the user.

The handle preferably is disposed across the housing, for example from one side to the other, generally transverse to the length of the apparatus, the length of the apparatus being generally the direction from the opening of the housing to the opposing end. Typically, the handle is disposed at least 50% along the length of the housing and more typically at least 60% along the length, that is closer to the opposing end than to the opening. Normally, the handle will be disposed at a position between 50 and 75% of the length of the housing.

The weight in the exercise apparatus may be provided in a first embodiment by the material of the housing itself and/or the handle itself.

Alternatively, or additionally, in a second embodiment, the weight may be provided by separate weighted elements disposed within the body of the housing or within the centre of the handle. For example, weighted elements may be interspersed in a plurality of different locations through the housing and/or may be disposed between two layers of the housing. In another example, weighted elements may be provided within the core of the handle (e.g. as aluminium or lead weighting within the core of the handle or as the material of the handle which may be coated with a plastic or rubber grip).

In a yet, further third alternative or additional embodiment, the weight may be provided in association with the housing and/or handle. For example, one or more weighted elements may be provided and be disposed in one or more locations in association with the housing on the internal or external surface. In one embodiment, the weight is substantially C-shaped, L-shaped or U-shaped element. The housing may be provided with moulding to help locate and secure such a weighted element.

In a particularly preferred embodiment, the weight of the apparatus is provided by the material of the housing and/or the handle and optionally as a separate element disposed in the handle. The weight of the apparatus may be distributed about the housing by the thickness of the material across the housing and the shape and distribution of vents about the housing.

Preferably, the weight provided is generally provided so that it is balanced about the location of the handle. Most preferably, the weight is distributed so that the fulcrum is at the handle. This is of particular importance to the usability of the apparatus and to remove strain from the wrist and other parts of the body, such as the shoulders, that may experience stress if using an imbalanced weighted apparatus.

The housing of the apparatus incorporates a plurality of vents. The vents may be formed in the portion of the housing covering the wrist/forearm and/or the portion of the housing covering the hand, at and/or toward the opposing end from the handle and/or toward the opening from the handle and/or vents may be formed in the opposing end portion of the housing. Vents may be provided on the upper and/or lower surfaces of the housing. Preferably, vents are provided in the upper and lower surfaces of the housing.

Vents may be any suitable shape. For example, the vents may be elongate oval or ellipse-shaped extending generally along the length of the housing or at an angle thereto of up to 45 degrees. Alternatively, the vents may be generally rectangular in shape extending across the width of the housing, preferably front and back The vents play a critical role in the function of the apparatus. In addition to enabling circulation of air through the housing to enable cooling and escape of heat and moisture from the apparatus (thereby enabling greater comfort and improved grip), the vents also facilitate the rapid movement of the training apparatus during training by reducing drag. The wider dimensioned upper and lower surfaces are provided with a substantial proportion of vents which enable through flow of air and reduce drag enabling more rapid exercise movements using the apparatus without adding to the strain to certain joints. This is a particular benefit of the apparatus.

Preferably, at least 10% of the area of the upper and lower surfaces of the housing are vents. More preferably, at least 30% of the area of the upper and lower surfaces of the housing are vents. Still more preferably, the vents make up from 40 to 75% of the area of the upper and lower surfaces of the housing, for example from 45 to 55% and most preferably about 50% or at least 50%.

In a particular alternative embodiment, the proportions of the area that is vents mentioned above apply to the whole surface area of the housing.

Preferably there are at least 3 vents in each of the upper and lower surfaces of the housing and optionally at least four vents.

The surface of the housing may be provided with non-slip means. The non-slip means may particularly be provided on the external surface and more particularly on the end (being the opposing end to the opening) of the housing. The non-slip means comprises may comprise a plurality of protrusions that protrude from the surface. Preferably, the non-slip means comprises a non-slip material.

The housing may be formed of any suitable material. The housing may comprise rubber. Preferably the housing comprises or more particularly consists essentially of polypropylene rubber. Optionally, the housing comprises another thermoplastic or generally pliable plastic or rubber-consistency material.

In a preferred embodiment, the handle is disposed in the handle at an angle offset from perpendicular to the longitudinal axis of the housing (being the centre line from opening end to opposing end). Preferably, the handle is offset by about 5° to about 20° from the perpendicular to the longitudinal axis, more preferably about 10° (e.g. from 8° to 15°, more preferably 12°). This being the angle the handle is offset from what would be straight across from side to side, so that the handle adjoins one side of the housing slightly closer the opening and the other side slightly closer the opposing end. The advantage of this configuration is that the grip of a user is not generally perpendicular to the longitudinal axis of the forearm and providing this offset handle enables a more balanced weighted apparatus to be provided to the user in use.

Preferably, the handle is provided with gripping means.

The gripping means may comprise a knurled bar.

Alternatively, the gripping means may comprise a non-slip material.

In a further alternative, the gripping means may comprise a plurality of finger indentations.

Preferably, the handle is coated or impregnated with a formulation effective to inhibit bacterial growth. Optionally, reusable or disposable grip handles may be provided to fit on the handles for each individual user.

In a third embodiment, as mentioned above, the weight preferably is substantially U-shaped.

Preferably, in this embodiment, the weight extends either side of the handle, with the majority of the weight being located in the end of the housing opposite the opening. Still, however, the weight is preferably balanced about the handle so that the handle represents the centre of balance (or centre of gravity) of the apparatus.

The weight may be built into the housing. Preferably, the handle is secured to the weight. The handle may be welded to the weight.

Preferably, the housing may comprise a rigid material.

The rigid material may be plastic.

The plastic may be injection moulded.

Optionally, The housing may comprise two halves joined together by any one of rivets, clip connectors, adhesives.

In another embodiment, the housing and handle may be formed in a single unit by injection moulding and secondary or overmoulding where necessary.

Optionally, the apparatus is provided in weights of from 0.5 kg to about 5 kg, such as 1 kg, 1.5 kg, 2 kg, 2.5 kg, 3 kg, 3.5 kg, 4 kg or 4.5 kg. Optionally the apparatus may be provided in a smaller weight and a larger weight alternative, such as a 1.5 kg and a 2.5 kg or a 1 kg and a 2 kg alternative.

An apparatus may be provided with a 1 kg or 1.5 kg weight simply by distribution of the weight through the material of the housing. Optionally a second, heavier alternative may be provided using the same mould as for the lower weight simply by using a denser material, or by providing in the construction an additional or separate weight within the handle so as to provide a 2 kg or 2.5 kg weight, typically providing an extra kg of weight. The apparatus according to these embodiments is preferably provided in accordance with the first embodiment set out above in relation to how the weight is distributed and more preferably comprises the high proportion of vents mentioned above.

The housing may be any suitable dimensions. Preferably, the length is from 15 to 30 cm, more preferably 17 to 28 cm, e.g. 18 to 25 cm. The diameter of the housing at its widest part is preferably from 14 cm to 18 mm, preferably 15.5 to 17 cm, e.g. about 16 cm. The opening end is preferably oval and may have dimensions of 100 to 130 mm by 80 to 100 mm and preferably 120 mm by 90 mm.

The handle may be disposed in the housing more than half way along its length and typically between 7 and 10 twelfths of the way along its length, e.g. about two thirds along its length. For example, the handle may be disposed about 14 to 20 cm along the length of the housing, e.g. about 15 to 18 cm along.

In one embodiment the apparatus of the invention, the apparatus may further comprise one or more of the following features individually or in combination:

- vents configured to effectuate sufficient air circulation throughout the interior of the housing;
- vents are located on both a hand-covering portion of the housing and a wrist-covering portion of the housing
- the weight is substantially U-shaped
- the weight extends either side of the handle, with the majority of the weight being located in the end of the housing opposite the opening
- the weight is built into the housing
- the handle is secured to the weight the handle is welded to the weight the housing comprises a rigid material the rigid material is plastic the plastic is injection moulded; and the housing comprises two halves joined together by any one of rivets, clip connectors, adhesives.

For a better understanding of the invention and to show how embodiments of the same may be carried into effect, reference will now be made, by way of example, to the accompanying diagrammatic drawings, in which.

In the figures, like references denote like or corresponding parts.

Figure 1:
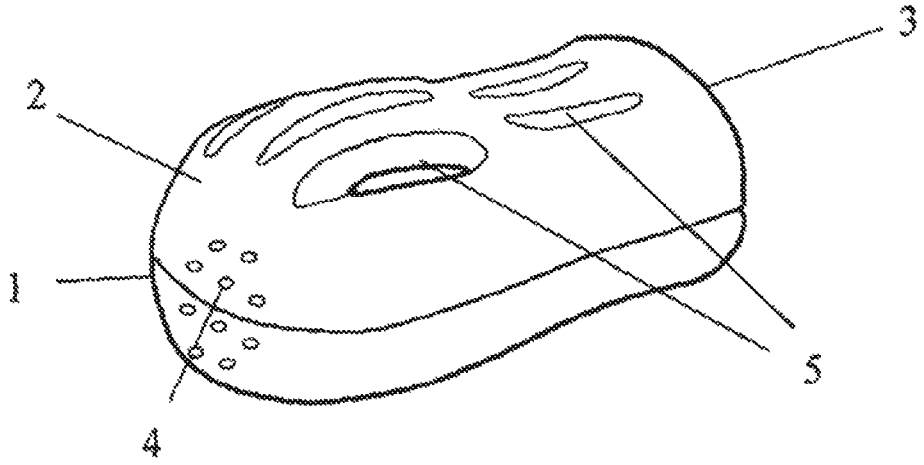
FIG. 1 shows one example of one embodiment of an exercise apparatus in isometric view.

FIG. 1 shows an exercise apparatus 1 comprising a housing 2 provided with an opening 3 for a user to insert their hand. The surface of the housing 2 may be provided with grip 4, such as a plurality of protrusions from the surface of the housing 2, that provide grip when the exercise apparatus 1 is placed against a surface such as the floor. The housing 2 is provided with a plurality of vents 5. These vents 5 allow for air ventilation throughout the interior of the housing 2, and encourage air to circulate about hand of the user, preventing the hand from becoming sweaty, and preventing perspiration from building up inside the housing 2.

The housing 2 may be formed from a rigid, semi-rigid or flexible material for different purposes. The housing 2 when formed from a rigid material maintains the opening 3 in an open position. The opening 3 may be circular, or may take the form of a different shape. By being held in an open position, the opening 3 allows a hand to be easily and quickly inserted into the interior of the housing 2. It also allows the hand to be removed quickly and easily, if the user wishes to drop or release the exercise apparatus 1.

Figure 2:
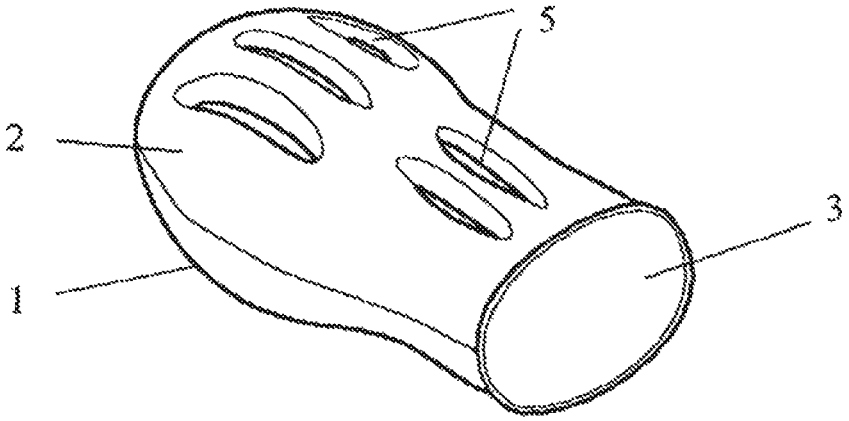
FIG. 2 shows a further isometric view of the exercise device of FIG. 1, showing an opening to receive a hand of a user.

FIG. 2 shows a further isometric view of the exercise apparatus 1, showing the opening 3 in a permanently open position. The housing 2 may comprise a single vent 5, or may comprise a plurality of vents 5 within both the hand-covering portion and the wrist-covering portion of the housing 2. The vents 5 are configured to effectuate sufficient air circulation throughout the interior of the housing 2. The vents 5 may be located on the uppermost surface of the housing 2, or the lowermost surface of the housing 2, or both.

Figure 3:
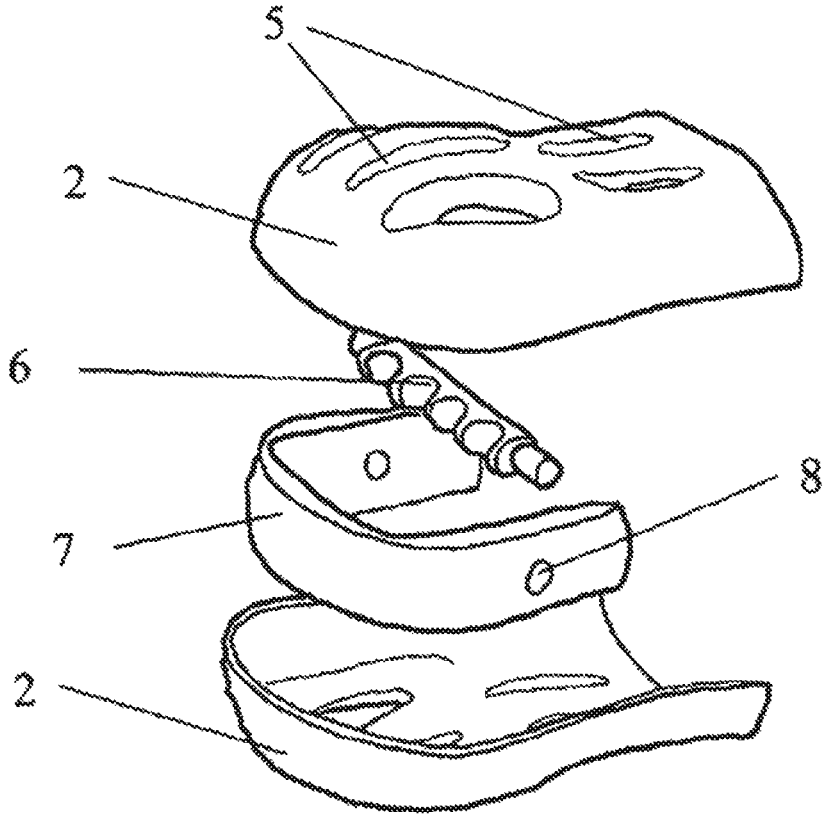
FIG. 3 shows an exploded view of the exercise apparatus of FIGS. 1 and 2, showing one embodiment of a handle.

FIG. 3 shows the exercise apparatus 1 in exploded view, showing the housing 2 formed in two halves. Each half of the housing 2 may be injection moulded from a plastics material, or rubber material, and the halves may be joined together by rivets, clip connectors, adhesives or other suitable means. Inside the housing 2 is a handle 6 that is provided with gripping means for the user to grip onto when their hand is inside the exercise apparatus 1. The user can reach inside the housing 2 of the exercise apparatus 1 and grip hold of the handle 6 in order to perform their exercises. The handle 6 may comprise a knurled bar, a rubberised material secured to the handle, or may incorporate a plurality of finger indentations as shown. The finger indentations encourage the user to grip the handle 6 in a specific way.

The handle 6 may be fastened to the housing 2, or may be fastened to a weight portion 7 that is located within the housing 2. The handle fastening means 8 within the weight portion 7 may comprise a hole into which the handle 6 locates. If both the handle 6 and the weight portion 7 are formed from a metal material, they may be welded together.

The weight portion 7 is configured to extend either side of the handle 6, and therefore in use along the sides of the hand of the user, with the bulk of the weight being located towards the end of the housing 2, opposite the opening 3. When the handle 6 is being gripped by the user, the weight 7 is therefore within the portion of the housing 2 located beyond their grip, and beyond the handle 6. The weight 7 may alternatively be located through the housing 2, or may be interspersed in a plurality of different locations throughout the housing 2, to have exercise apparatus 1 suitable for different exercises.

Figure 4:
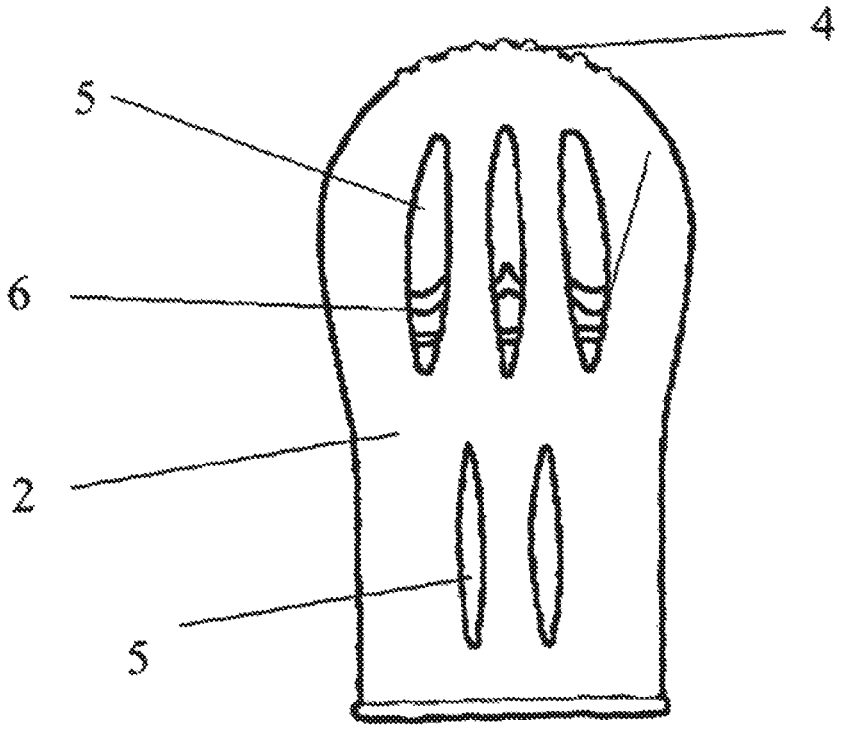
FIG. 4 shows a plan view of the exercise apparatus of FIGS. 1, 2 and 3, showing a plurality of vents.
Figure 5:
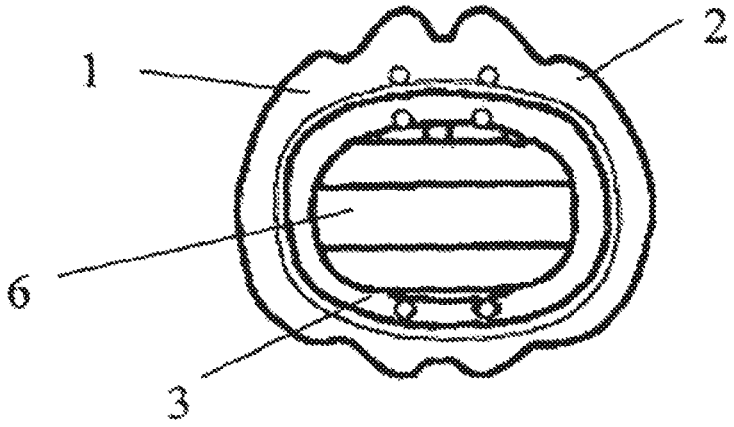
FIG. 5 shows an end view of the exercise apparatus according to one embodiment, showing the opening of the housing.

FIG. 4 shows a plan view of the exercise apparatus 1 showing the handle 6 through the plurality of vents 5 within the housing 2. FIG. 5 shows an end view of the exercise apparatus 1 showing the opening 3 within the housing 2, and the handle 6 stretching across the interior of the housing 2, sufficiently spaced from the housing 2 and the weight 7 to allow a user to grip the handle 6.

Figure 6:
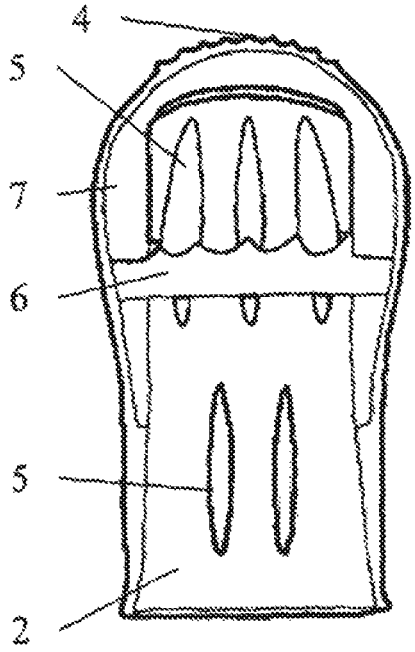
FIG. 6 shows a section view of one embodiment of the exercise apparatus, showing one embodiment of the configuration of the plurality of weighted portions.
Figure 7:
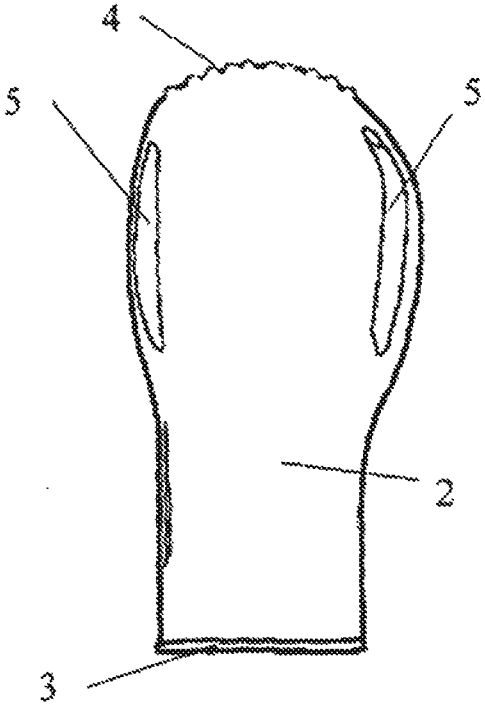
FIG. 7 shows a side view of the exercise apparatus according to FIG. 1.

FIG. 6 shows a section view through the exercise apparatus 1, showing the relationship of the handle 6 to the weight 7, the handle 6 passing through the weight 7. FIG. 7 shows the a side view of the exercise apparatus 1, showing one embodiment of the shape of the housing 2, with flattened portion within the surface of the housing 2, to allow the exercise apparatus 1 to be placed on a floor for when performing exercises such as press-ups.

The exercise apparatus 1 according to the first embodiment effectively forms a weighted mitt or glove into which the user places their hand, and grips the handle 6. The exercise apparatus 1 can be lifted up above the user's head, can be raised or lowered from the ground, and can be used for numerous different exercises for both fitness and rehabilitation, for much the same exercises to which different weights of dumbbells and kettelbells are used. The flat portion on the surface of the housing 2 allows the user to rest the housing 2 on the floor whilst performing exercises such as press-ups, whilst also being able to lift the exercise apparatus 1 from the floor as and when desired.

The exercise apparatus 1, can be easily released from the hand of the user, by the user simply letting go of the handle 6. The housing 2 provides protection for the hand of the user, and supports the weight 7 and the handle 6 in the correct positions. Should the user need to release the weight, they can let go of the handle, and allow the exercise apparatus 1 to drop to the floor, much like with dumbbells and kettelbells. The weights 7 and not therefore retained on the user's hand or wrist, where they cannot be released so easily if required.

The interior of the housing 2 may incorporate a plurality of mouldings to help to locate and secure the weight 7 and the handle 6. The weight 7 may be U-shaped as shown in the figures, or may be C-shaped, L-shaped or similar shape such that weight is provided within the housing 2 of the exercise apparatus 1. The weight 7 may comprise a plurality of smaller individual weights, grouped within the housing 2. The weights 7 may be secured between two layers of housing 2, not shown.

The opening 3 may comprise a rim or rounded-edge. The housing 2 and the handle 6 may comprise a rubber composite material. The housing 2 may alternatively comprise a thick plastic material. The weight 7 may be formed from steel, or similar heavyweight metal, or alternative material with suitable density. The housing 2 may alternatively comprise a thick and durable material such as leather or other semi-rigid material to give sufficient protection to the user's hand whilst providing sufficient rigidity to maintain the structure.

Figure 8:
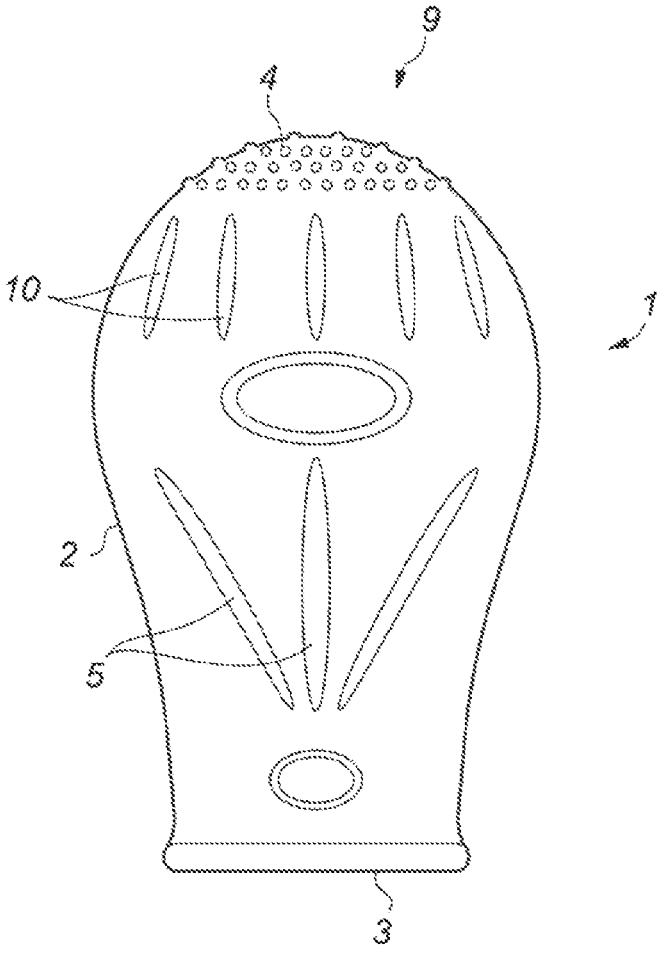
FIG. 8 shows a top view of an exercise apparatus according to another embodiment.

With reference to a second embodiment, as shown in FIG. 8, an apparatus 1 comprises a housing 2, preferably substantially of rubber or polypropylene rubber or like material which may be moulded in two parts or as a single piece, of material having a cumulative mass of up to about 1 to 1.5 kg, for example. The housing has an opening 3 at one end and gripping protrusions 4 and small vent holes 8 at the opposing end 9. Elongate vents 5 are provided on the upper and lower surfaces (three on each), whilst further vents 10 are provided on the upper and lower surfaces and sides toward the opposing end, making a total of 16 vents in one particular embodiment. This significantly reduces drag in movement of the housing and enhances the interior cooling effect.

Figure 9:
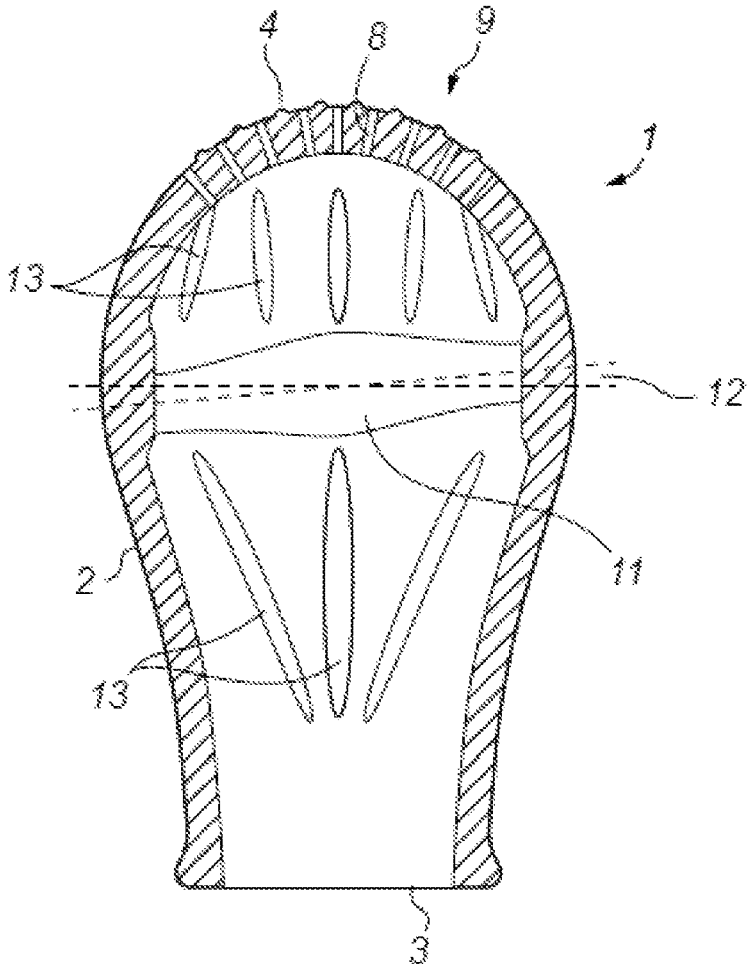
FIG. 9 shows a cross-section of an apparatus of FIG. 8.

A cross-section of the apparatus 1 of FIG. 8 is shown in FIG. 9 in which the housing 2 is sectioned lengthwise to reveal the interior of the housing. A handle 11 is disposed about two-thirds along the length of the housing 2 disposed from side to side at an angle 12 of about 10° to the horizontal, or to the perpendicular of the longitudinal axis of the housing running from opening 3 to opposing end 9. Thus a more comfortable grip and better balanced apparatus may be provided. Vents 10 and vents 5 in the other surface of the housing 2 are shown as are holes 13.

Figure 10:
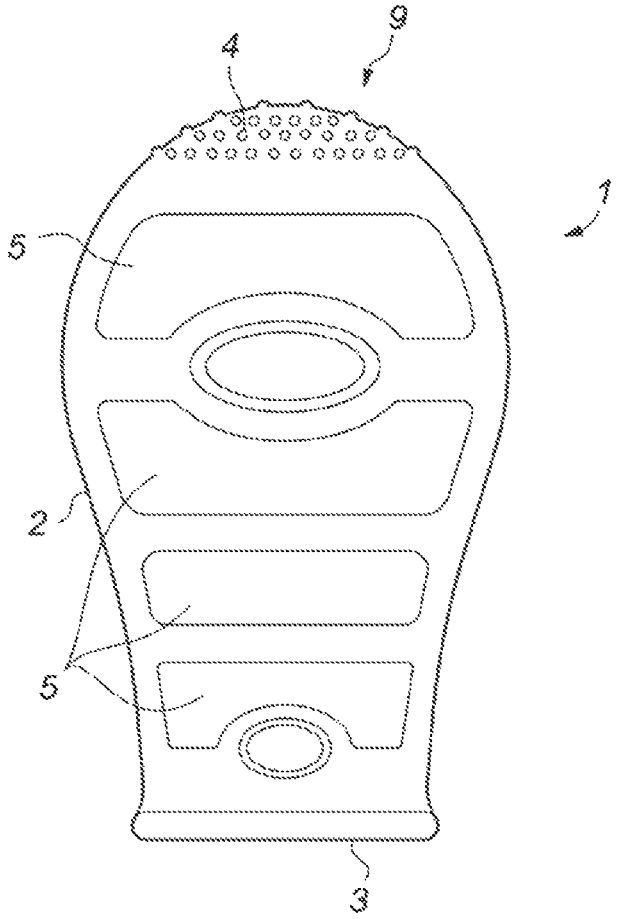
FIG. 10 shows a top view of a yet further and most preferred embodiment of the apparatus of the present invention.

FIG. 10 illustrates a particularly preferred embodiment of the apparatus 1 in which the housing 2 comprises significantly sized vents 5 in both upper and lower surfaces so that the vents 5 make up at least 50% of the surface area of the housing 2, which is essentially formed of a skeletal structure of the material, which is provided greater thicknesses. Two large vents are provided either side of the handle (toward the opening and toward the opposing end) which cover at least 60%, preferably at least 75% of the width of the housing at that point and no less than 15% of the length (e.g. 15 to 20%), on both the upper and lower surfaces. Preferably at least three vents or even four or more are provided on each of the upper and lower surfaces. Thus, very little drag and very effective cooling can be achieved whilst using the apparatus 1 in vigorous and aerobic style exercises in housings in which the weight (of e.g. 1 to 1.5 kg in the housing and optionally a further 1 kg in the handle) is distributed in a balanced manner about the handle, which is again preferably disposed ⅔ of the way along the length of the housing and preferably at an angle e.g. 10 to 15° offset from perpendicular to the longitudinal axis of the housing.

In this specification, the word "comprise" has its normal dictionary meaning, to denote non-exclusive inclusion. That is, use of the word "comprise" (or any of its derivatives) to include one feature or more, does not exclude the possibility of also including further features.

All of the features enclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings), may be replaced by alternative features serving the same, equivalent or similar purpose, unless expressly stated otherwise. Thus, unless expressly stated otherwise, each feature disclosed is one example only of a generic series of equivalent or similar features.

The invention claimed is:

1. An exercise apparatus comprising:

a housing configured to receive a hand of a user and extend, in use, up to a wrist area of the user, the housing comprising an upper surface, a lower surface and sides between the upper surface and the lower surface, wherein the housing incorporates a plurality of vents, the plurality of vents located on the upper and the lower surfaces of the housing;

an opening within the housing for receiving the hand of the user;

a handle inside the housing, wherein the handle is disposed within the housing closer to an end of the housing which opposes the opening than to the opening; and at least one weight provided by, configured within or disposed in relation to the housing and/or the handle, wherein at least 30% of the area of the upper and the lower surfaces of the housing is the plurality of vents, whereby in use, the user grips the handle with the hand inside the housing, to lift the at least one weight to perform exercises with the exercise apparatus.

2. The exercise apparatus according to claim 1, wherein the at least one weight is provided by a material of the housing itself and/or the handle itself.

3. The exercise apparatus according to claim 1, wherein the at least one weight is balanced about the location of the handle.

4. The exercise apparatus according to claim 1, wherein the plurality of vents is provided in the upper and the lower surfaces of the housing.

5. The exercise apparatus according to claim 1, wherein from 40 to 55% of the area of the upper and the lower surfaces of the housing is the plurality of vents.

6. The exercise apparatus according to claim 1, wherein there are at least 3 vents in each of the upper and the lower surfaces of the housing.

7. The exercise apparatus according to claim 1, wherein the handle is disposed in the housing at an angle offset from perpendicular to a longitudinal axis of the housing.

8. The exercise apparatus according to claim 1, wherein the housing comprises two halves joined together by any one of rivets, clip connectors, and adhesives.

9. The exercise apparatus according to claim 1, wherein the plurality of vents is located within both a hand-covering portion of the housing and a wrist-covering portion of the housing.

10. The exercise apparatus according to claim 1, wherein the at least one weight extends to either side of the handle, with a majority of the at least one weight being located towards the end of the housing opposite the opening.

* * * * *